United States Patent [19]

Sinkovec

[11] 4,051,599

[45] Oct. 4, 1977

[54] BEAM COMPASS

[75] Inventor: Andrej Sinkovec, Stuttgart, Germany

[73] Assignee: Friedrich Frech, Stuttgart, Germany

[21] Appl. No.: 674,895

[22] Filed: Apr. 8, 1976

[30] Foreign Application Priority Data

Apr. 11, 1975 Germany ..... 2515923

[51] Int. Cl.[2] ..... B43L 9/04

[52] U.S. Cl. ..... 33/27 C; 33/158

[58] Field of Search ..... 33/27 C, 158, 159, 160

[56] References Cited

U.S. PATENT DOCUMENTS

| | | | |
|---|---|---|---|
| 586,626 | 7/1897 | Rooney | 33/159 |
| 1,629,143 | 5/1927 | Bungart | 33/159 X |
| 2,512,235 | 6/1950 | Lankford | 33/27 C |
| 2,539,097 | 1/1951 | O'Rourke | 33/159 |
| 3,589,013 | 6/1971 | Colon | 33/27 C |

*Primary Examiner*—Charles E. Phillips
*Attorney, Agent, or Firm*—Hans Berman

[57] ABSTRACT

A beam compass consisting of a triangular scale and two trammel heads, each including a hollow slide body having an outer face and three, approximately equiangularly offset inner faces bounding a passage through the slide body. Guide rails project from the inner faces into respective grooves of the scale. An arm projects from the outer face of each slide body at right angles to the scale, and its free end carries an attaching device for a compass point or writing implement.

11 Claims, 4 Drawing Figures

BEAM COMPASS

This invention relates to beam compasses, and particularly to an improved trammel head for use with a conventional, triangular scale constituting the beam of the compass.

It is known from U.S. Pat. No. 3,589,013 to provide each trammel head of a beam compass with an approximately U-shaped yoke whose bight portion is received in a groove of a triangular scale and whose leg portions extend outward of the groove along opposite, parallel faces of the triangularly prismatic trammel body. The yoke is clamped fast in the groove of the scale by means of a threaded pin projecting from the outer face of the trammel body and a nut on the pin engaging the free ends of the leg portions. A compass point or writing implement projects from the trammel body in alignment with the pin. The yoke holds the engraved calibration markings of the scale in clamping engagement with the trammel body.

According to the present invention, there is provided a trammel head whose hollow slide body has three inner faces bounding the passage through the body. A guide rail projects from each inner face into the passage. An arm mounted on the slide body projects from the outer face of the latter perpendicularly to the direction of the passage. A free end of the arm is provided with an attaching device for a compass point or the like. A clamping device spaced from the guide rails permits the slide body to be secured to a beam received in the passage.

Other features, additional objects, and many of the attendant advantages of this invention will readily be appreciated as the same becomes better understood by reference to the following detailed description of preferred embodiments when considered in connection with the appended drawing in which.

Figure 1:
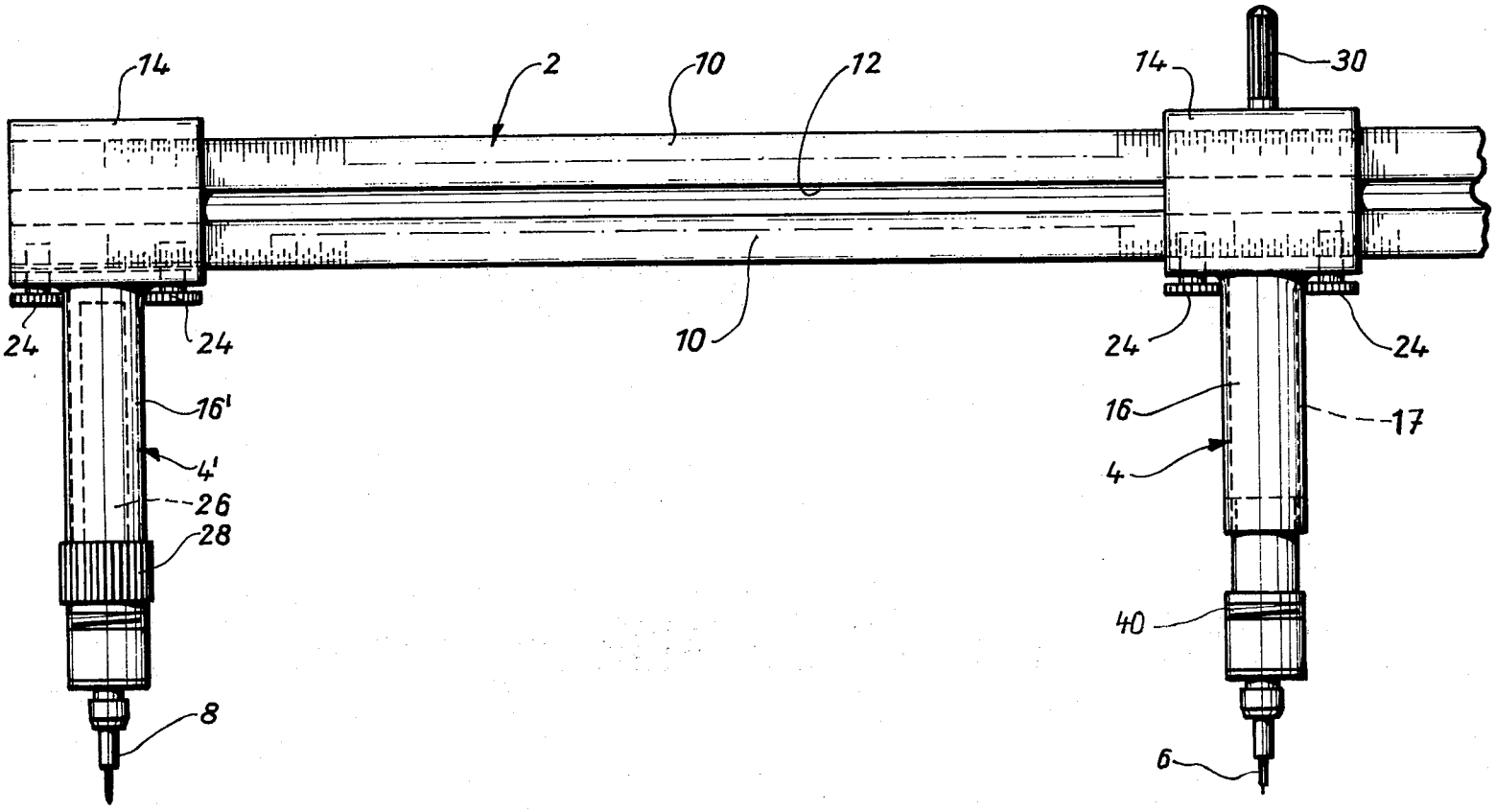
FIG. 1 shows a beam compass of the invention in front elevation.

Referring now to the drawing in detail, and initially to FIG. 1, there is seen a beam compass whose beam 2 is a conventional, triangular scale 2. A pair of trammel heads 4, 4′ is longitudinally adjustable on the scale 2. The trammel head 4 carries a needle point attachment 6 and the trammel head 4′ a stylograph attachment 8.

The scale 2 has three edge ribs 10 carrying calibration markings. The three faces between the edges of the scale are each formed with a longitudinal groove 12 of cylindrically arcuate cross section which separates two ribs. The trammel heads 4, 4′ each have a slide body 14 of somewhat resilient, transparent, synthetic resin composition. A tubular arm 16, 16′ projects from an outer face of each slide body 14, 14′ at right angles to the direction of elongation of the scale 2.

Two clamping screws 24 on each slide body 14, 14′ permit the trammels to be secured longtiduinally on the scale 2, as will presently be described in more detail. The needle point attachment 6 and the stylograph attachment 8 are secured in the bores of respective arms 16, 16′ by matingly engaged threads 17, the bore of each arm being of sufficient size to receive an ink cartridge 26 of the attachment 8.

The free end of the arm 16′ also carries a rotatably mounted knurled ring 28, and a knurled, pin-shaped handle 30 projects from the outer face of the body portion 14 of the trammel head 4 in alignment with the needle point 6 and away from the latter. The handle 30 and the ring 28 respectively are gripped by the two hands of a draftsman wishing to draw a large circle by means of the illustrated compass. Threads 40 on the attachments 6, 8 may secure non-illustrated protective caps over the needle point and the styolograph.

Figure 2:
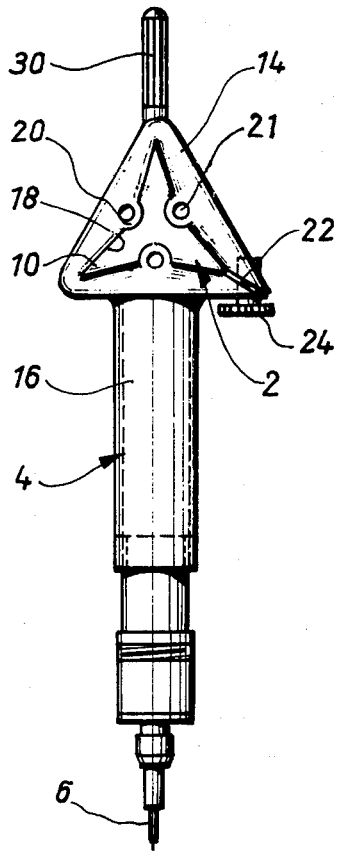
FIG. 2 illustrates the compass of FIG. 1 in right side elevation.
Figure 3:
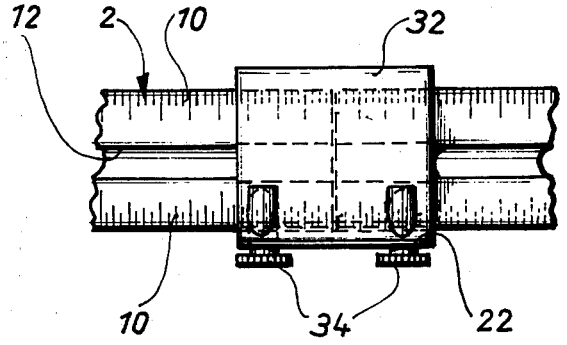
FIG. 3 is a fragmentary, front-elevational view of elements of two beam compasses as shown in FIG. 1 and of a coupling sleeve connecting the same.

As is better seen in the end view of FIG. 2, the overall cross sectional shape of the scale 2 is that of a triangular star. It is received in a passage 18 of each slide body 14 bounded by three inner faces of the body which are equipped with respective central guide rails 20. The guide rails are tubular, integral portions of the body 14 whose bores receive reinforcing metal rods 21. The outer face of the body 14 had the approximate cross-sectional shape of an equilateral triangle A slot 22 extends through he body 14 between an edge of the outer face and the juncture of two inner faces, and the two ends of the slot 22 are bridged by the clamping screws 24 which permit the width of the slot, and thereby the cross section of the passage 18, to be varied. In the position illustrated in FIG. 2, the trammel head 4 is longitudinally fixed on the scale 10 by clamping engagement of the guide ribs 20 with the scale in the grooves 12 of the latter. Even in the clamped condition of the slide body 14, there is some clearance between the three, approximately equiangularly offset inner faces of the body 14 and the calibration marks on the scale 10 which are thereby protected from early obliteration.

If is is desired to draw a circle of a radius greater than the length of the scale 10, which is a common draftsman's tool, two or more identical scales 10 may be coupled end-to-end in longitudinal alignment by means of a coupling sleeve 32 identical in cross section with the slide body 14 and capable of being clamped on the coupled scale ends by means of clamping screws 34 bridging a slot 22 in he sleeve 32. The trammel heads 4, 4′ are arranged on the two scales respectivly in a manner obvious from FIG. 1, and a third trammel head, not shown, may be mounted on either scale near the sleeve 32 and equipped with a roller attachment movably engaging the drawing surface between the needle point and the stylograph for better support of the compass.

Figure 4:
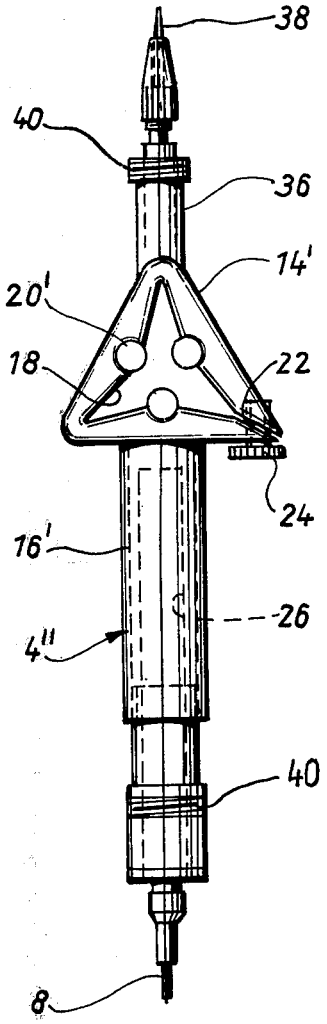
FIG. 4 shows a modification of the compass of FIG. 1 in left side elevation.

FIG. 4 shows one of the two modified trammel heads of another embodiment of the invention. The head 4″ has an arm 16′ carrying a stylograph attachment 8 including an ink cartridge 26 as described with reference to FIG. 1. The arm 16′ projects from one of the flat outer face portions of a slide body 14′ which slide body is equipped with grooves of cylindrically arcuate cross section where the slide body 14 of FIG. 2 has tubular, integral guide rails 20. The grooves conformingly receive metal rods 20′ of cylindrically arcuate cross section projecting into the passage 18 of the head 14′ and into the grooves 12 of a scale 10 when the scale is inserted in the passage 18 and secured by clamping screws 24 bridging a slot 22 as described above.

Another arm 36 projects from the edge of the slide body 14′ opposite the flat face portion carrying the arm 16′, the arms 16′, 36 being longitudinally aligned in a direction perperdicular to the axis of the passage 18. The arm 36 carries a pencil attachment 38. The non-illustrated other trammel head of the beam compass partly shown in FIG. 4 differs from the illustrated device by needle point attachments on its two aligned arms. The modified compass may thus be used for making a pencil drawing, and merely turned around for inking the drawing. The inoperative needle points and writing implements are preferably protected in either mode of use by caps on threads 40, as described above.

While the illustrated embodiments of the invention are preferred at this time, variations will readily suggest themselves to those skilled in the art. The outer faces of the slide bodies and coupling sleeve may be of a cross section different from the illustrated, approximately equiangular, triangular shape, and a cylindrical outer face is specifically contemplated. The slots bridged by the clamping screws 24, 34 may be located otherwise than is shown in FIGS. 2 and 4, and the screws may engage metallic inserts in the plastic slide bodies or sleeves. The plastic elements may be made in any known manner, but are preferably sections of a plastic extrudate in which the rods 20 are embedded during extrusion. Slide bodies and sleeves of different external shape, of course, may be combined in the same beam compass.

It should be understood, therefore, that the foregoing disclosure relates only to preferred embodiments of the invention, and that it is intended to cover all changes and modifications of the examples of the invention herein chosen for the purpose of the disclosure which do not constitute departures from the spirit and scope of the invention set forth in the appended claims.

What is claimed is:

1. A beam compass comprising:

a. a trammel head including 1. a hollow slide body having an outer face and three, approximately equiangularly offset inner faces bounding a passage extending in a predetermined direction through said slide body,
2. a guide rail projecting from each of said inner faces into said passage, each guide rail being elongated in said direction,
3. an arm mounted on said slide body and projecting from said outer face perpendicularly to said direction, said arm having a free end remote from said slide, and
4. attaching means for attaching a compass point to said free end;

b. an elongated scale of triangular cross section having three longitudinal faces formed with respective longitudinal grooves, 1. said scale being received in said passage,
2. said rails respectively engaging said scale in said grooves,
3. each of said longitudinal faces being separated from a respective one of said inner faces by a clearance; and c. clamping means on said trammel head spaced from said rails for securing said slide body to said scale.

2. A beam compass as set forth in claim 1, wherein said slide body is formed with a slot extending therethrough between said passage and said outer face, said clamping means bridging said slot for varying the width of said slot and for thereby varying the cross section of said passage.

3. A beam compass as set forth in claim 1, wherein said passage has an axis extending therethrough in said direction, said guide rails being distributed approximately equiangularly about said axis.

4. A beam compass as set forth in claim 3, wherein each of said guide rails has a tubular portion integral with said slide body, and a reinforcing portion conformingly received in said tubular portion, said reinforcing portion being elongated in said direction.

5. A beam compass as set forth in claim 4, wherein said slide body and said tubular portion jointly constitute a unitary body of synthetic resin composition, and said reinforcing portion consists of metallic material.

6. A beam compass as set forth in claim 3, wherein said inner faces are formed with respective grooves elongated in said direction and receiving said guide rails, said guide rails consisting essentially of metallic material.

7. A beam compass as set forth in claim 1, a ring mounted on said free end for rotation about an axis perpendicular to said direction.

8. A beam compass as set forth in claim 1, further comprising a handle member mounted on said slide body and projecting from said outer wall in alignment with and away from said arm.

9. A beam compass as set forth in claim 1, further comprising another arm mounted on said slide body and projecting from said outer wall in alignment with and away from said first-mentioned arm, said other arm having a free end remote from said slide body, and attaching means for attaching a compass point to the free end of said other arm.

10. A head as set forth in claim 1, wherein each of said guide rails is permanently fixed to the associated inner face.

11. A beam compass as set forth in claim 1, wherein one of said longitudinal faces carries calibration markings.

* * * * *